US007780129B1

(12) United States Patent
Cundy

(10) Patent No.: US 7,780,129 B1
(45) Date of Patent: Aug. 24, 2010

(54) KIT FOR MOUNTING AN ARTICLE TO A WALL IN AN ELEVATED POSITION AND METHOD OF USING THE SAME

(76) Inventor: John Cundy, 49409 Shenandoah, Macomb, MI (US) 48044

( * ) Notice: Subject to any disclaimer, the term of this patent is extended or adjusted under 35 U.S.C. 154(b) by 747 days.

(21) Appl. No.: 11/458,744

(22) Filed: Jul. 20, 2006

(51) Int. Cl.
*A47G 29/00* (2006.01)

(52) U.S. Cl. ..... 248/231.91; 248/305; 248/339

(58) Field of Classification Search ..... 248/475.1, 248/488, 231.91, 339, 304, 305
See application file for complete search history.

(56) References Cited

U.S. PATENT DOCUMENTS 2,544,312 A * 3/1951 Hamilton ..... 248/210
3,069,019 A 12/1962 Schuster
3,285,686 A 11/1966 Beaver
4,071,976 A 2/1978 Chernewski
4,253,575 A * 3/1981 Van Winkle ..... 211/85.7
4,422,610 A * 12/1983 Hunt ..... 248/311.2
4,452,415 A * 6/1984 Arnold ..... 248/312.1
5,207,403 A * 5/1993 Penniman ..... 248/215
5,320,319 A 6/1994 Winger et al.
5,405,116 A * 4/1995 Shepherd et al. ..... 248/312.1
5,456,435 A 10/1995 Sweeney
6,003,824 A * 12/1999 Peterson et al. ..... 248/312.1
7,201,355 B1 * 4/2007 Zien et al. ..... 248/301

* cited by examiner

*Primary Examiner*—J. Allen Shriver, II
*Assistant Examiner*—Steven M Marsh
(74) *Attorney, Agent, or Firm*—Reising Ethington P.C.

(57) ABSTRACT

A mounting kit for mounting an article to a wall including: a first support hook including a first leg portion and a second leg portion, the first leg portion including a first face constructed and arranged to face a wall when the first support hook is mounted thereto, and the second leg portion including a first face constructed and arranged to face the wall at a spaced apart distance to provide a gap between the first face of the second leg portion and the wall; and the support block including a first face designed to face the wall when mounted thereto and a top face constructed and arranged to generally face upward toward the support hook when mounted on a wall.

4 Claims, 4 Drawing Sheets

KIT FOR MOUNTING AN ARTICLE TO A WALL IN AN ELEVATED POSITION AND METHOD OF USING THE SAME

TECHNICAL FIELD

The disclosure relates to a kit for mounting an article to a wall in an elevated position and a method of using the same.

BACKGROUND OF THE INVENTION

It is common for owners of both business establishments and residential homes to store articles. Such articles might include bins for storing recyclable trash, bins for storing beverage cans and bottles, particularly cans and bottles that can be returned to a store to recover a deposit associated with the purchase of the can or bottle. Other articles for storage include containers, storage chest, and bags. For a residential home, typically such articles may be stored, for example, in a garage or a basement on the floor. Such articles can take up a substantial amount of floor space.

SUMMARY OF THE INVENTION

One embodiment of the invention includes a mounting kit for mounting an article to a wall including:

a first support hook including a first leg portion and a second leg portion, the first leg portion including a first face constructed and arranged to face a wall when the first support hook is mounted thereto, and the second leg portion including a first face constructed and arranged to face the wall at a spaced apart distance to provide a gap between the first face of the second leg portion and the wall; and the support block including a first face constructed and arranged to face the wall when mounted thereto and a top face generally facing upward.

Other embodiments of the present invention will become apparent from the brief description of the drawing, detailed description, and appended claims and drawings provided hereinafter. It should be understood that the detailed description and specific examples, while indicating exemplary embodiments of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
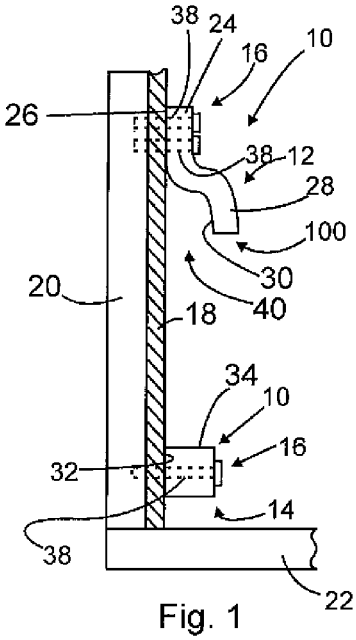
FIG. 1 illustrates a mounting kit according to one embodiment of the invention.

FIG. 1 illustrates one embodiment of the invention including a mounting kit 10. The mounting kit 10 includes a support hook 12 and a support block 14. A fastening means 16 is provided to fasten the support hook 12 and the support block to a wall 18. The fastening means 16 may be a nail, screw, bolt, rivet or an adhesive or similar means for fastening. As shown in FIG. 1, the fastening means 16 is a screw that extends into a stud 20 behind the wall 18. The wall 18 may be a piece of drywall, plywood, particleboard, or sheet of plastic, or the like. The support hook 12 includes a first leg portion 24 which includes a first face 26 positioned to face the wall 18. The support hook 12 also includes a second leg portion 28 connected to the first leg portion 24. The second leg portion 28 includes a first face 30 which is also positioned to face the wall 18, but is spaced a distance away from the wall 18 so that a gap 40 is provided between the first face 30 of the second leg portion 28 and the wall 18. The second leg portion 28 includes a free end 100 that does not engage the wall 18. The support block 14 is mounted to the wall 18 by a fastening means 16. The support block 14 includes a first face 32 positioned to face the wall 18 and a support face 34 which faces generally upward toward the support hook 12. The support block 14 is mounted to the wall 18 at an elevated position on the wall 18 above a floor 22. Through-holes 38 may be provided through the first leg portion 24 of the support hook 12 and through the support block 14 to accommodate a fastening means such as a screw. The support hook 12 may take on a variety of configurations including a lazy S shape as shown in FIG. 1 wherein the first face 26 of the first leg portion 24 and the first face 30 of the second leg portion 28 are each substantially flat and parallel (i.e., flat and parallel or approximately flat and parallel). However, the first face 26 of the first leg portion 24 and the first face 30 of the second leg portion 28 do not need to be flat or parallel provided that a gap 40 is provided between the second leg portion 28 and a wall 18.

Figure 2:
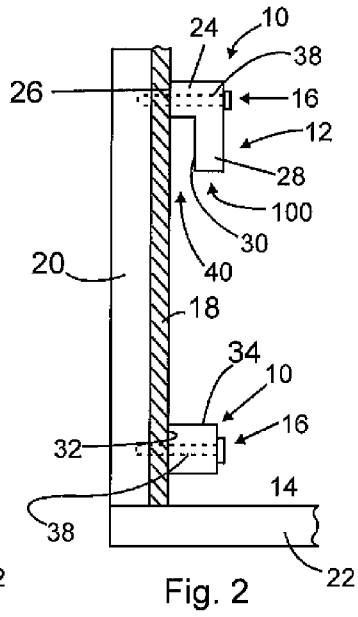
FIG. 2 illustrates a mounting kit according to another embodiment of the invention.

FIG. 2 shows another embodiment of a mounting kit 10 including a support hook 12 and a support block 14. In this embodiment, the support block 12 has a L shape and the second leg portion 28 includes a first face 30 spaced a distance from the wall 18 to provide a gap 40.

Figure 3:
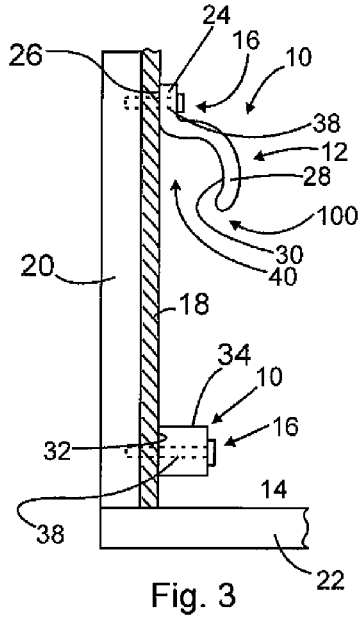
FIG. 3 illustrates a mounting kit according to another embodiment of the invention.

FIG. 3 shows another embodiment of a mounting kit 10 including a support hook 12 and support block 14. In this embodiment, the second leg portion 28 of the support hook 12 has a lazy C shape and includes a first face 30 spaced a distance from the wall 18 to provide a gap 40. However, in this embodiment, the first face 30 of the second leg portion is not flat and is not parallel to the first face 26 of the first leg portion 24.

The support hook 12 and support block 14 may be made from the same or different materials. The support hook 12 and support block 14 may be made from any of a variety of materials including, but not limited to, wood, metal, plastic, polymer based materials and/or composites.

Figure 4:
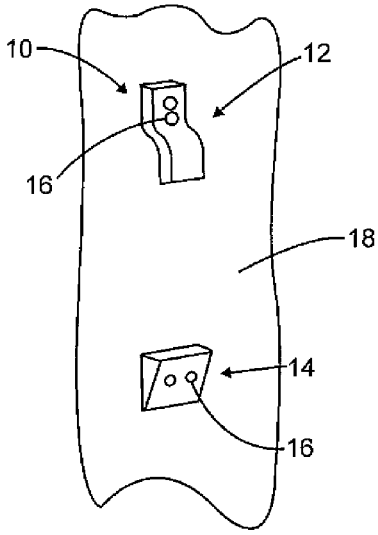
FIG. 4 illustrates a mounting kit according to one embodiment of the invention including a support hook and a support block.

Referring now to FIG. 4, a mounting kit 10 is illustrated mounted to a wall 18. The mounting kit 10 includes a support hook 12 and a support block 14 each fastened to the wall 18 by fastening means 16. As will be appreciated with respect to the invention illustrated in FIG. 5, the support block 14 illustrated in FIG. 4 is relatively short in length.

Figure 5:
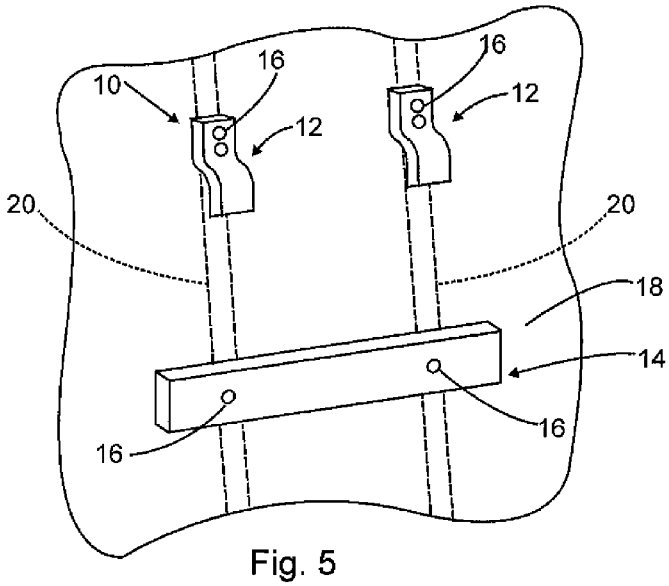
FIG. 5 illustrates a mounting kit according to another embodiment of the invention including two support hooks and an elongated support block.

Referring now to FIG. 5, one embodiment of a mounting kit 10 is illustrated including two support hooks 12 and an elongated support block 14. The support hooks 12 are each mounted to the drywall 18 using fastening means 16 such as a screw which extends through the drywall 18 and into a stud 20. The support block 14 is relatively long in length and extends across two spaced apart studs 20 to which the drywall 18 is attached. For example, the support block 14 may have a length ranging from about 16-20 inches. Fastening means 16 such as a screw extends through the support block 14 and into the stud 20.

Figure 6:
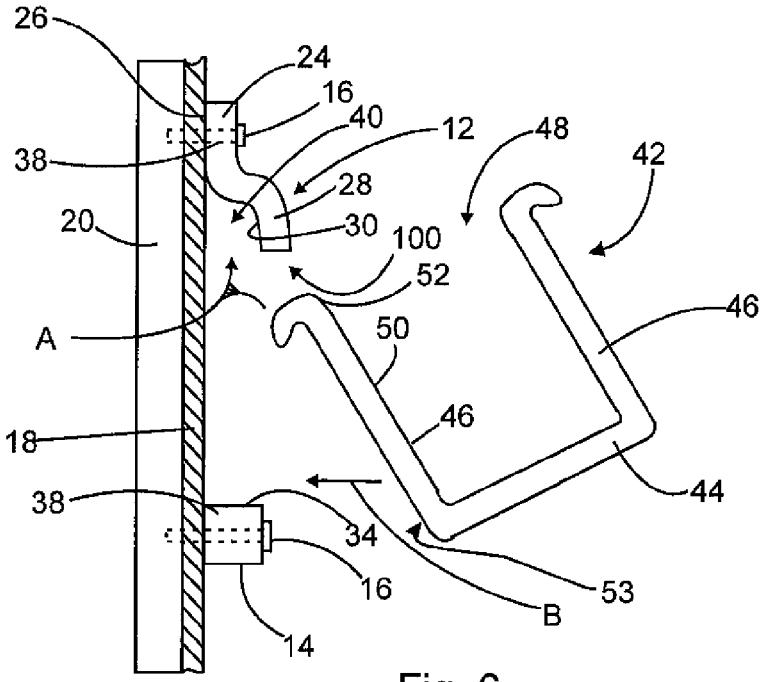
FIG. 6 illustrates one embodiment of a method of using a mounting kit according to the invention.
Figure 7:
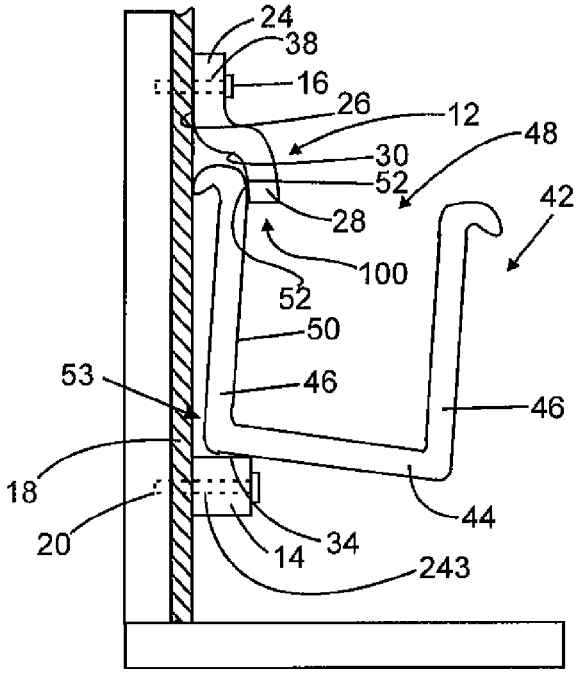
FIG. 7 illustrates one embodiment of a method of using a mounting kit according to the invention.

Referring now to FIG. 6, the mounting kit 10 may be fastened to a wall 18 as previously described and used to mount an article 42 such as a bin for storing recyclable trash articles, or can and beverage containers. The bin 42 includes a bottom or floor 44 and upwardly extending walls 46 to provide an opening 48 between the walls. Each wall 46 includes an inner face 50 and a lip 52 is provided near a top portion 54 of the wall 46. The bin 42 is removeably mounted to the wall 18 by tipping the side of the bin 42 so that the top portion 54 of the wall 46 may be moved upwardly in the direction of arrow A into the gap 40 provided between the first face 30 of the second leg portion 28 of the support hook 12 and the wall 18. Thereafter, a bottom portion 53 of the wall 46 of the container that is closest to the wall 18 is moved towards the wall 18 generally in the direction of arrow B so that the bottom 44 of the bin 42 rest on the top face 34 of the support block 14, as shown in FIG. 7. The support hook 12 and the support block 14 have been mounted on the wall 18 relative to each other so that at least a portion of the first face 30 of the second leg portion 28 of the support hook 12 engages the lip 52 of the bin 42.

Figure 8:
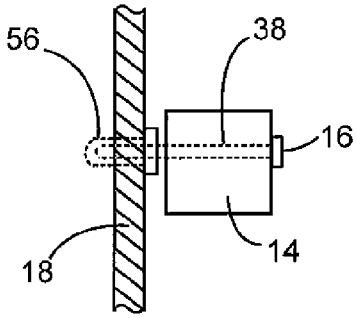
FIG. 8 illustrates one embodiment of a means for fastening useful in one embodiment of the invention.

Referring now to FIG. 8, the mounting kit 10 may also include a drywall anchor 56 which may be used with a fastening means 16 such as a screw to fix the support block 14 to a drywall sheet 18 when a stud 20 is not available.

Figure 9:
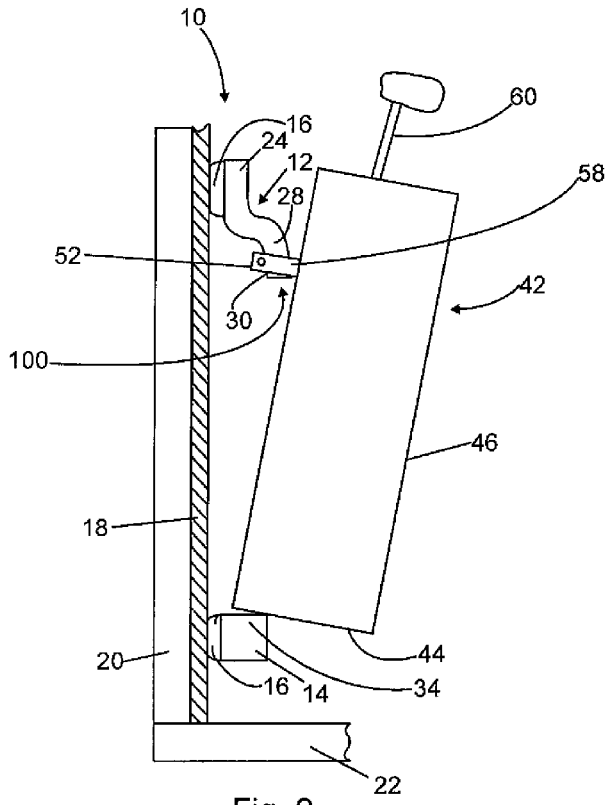
FIG. 9 illustrates one embodiment of a method of mounting an article using a mounting kit according to the invention.

Referring now to FIG. 9, another embodiment of the invention includes a mounting kit 10 which includes a support hook 12 and a support block 14 each of which have been fixed to a wall 18 using an adhesive 16. An article 42 is provided, in this case a golf bag which includes a bottom 44 and a cylindrical wall 46. A strap 58 has been attached to the cylindrical wall 46. The strap 58 provides a lip 52 which the first face 30 of the support hook 12 may engage while the top face 32 of the support block 14 engages the bottom 44 of the golf bag 42. Golf club 60 may be carried by the golf bag 42. In another embodiment, an article having a handle can be mounted in a similar fashion wherein the lip 52 engages a portion of the handle in a similar manner as the strap 52.

Figure 10:
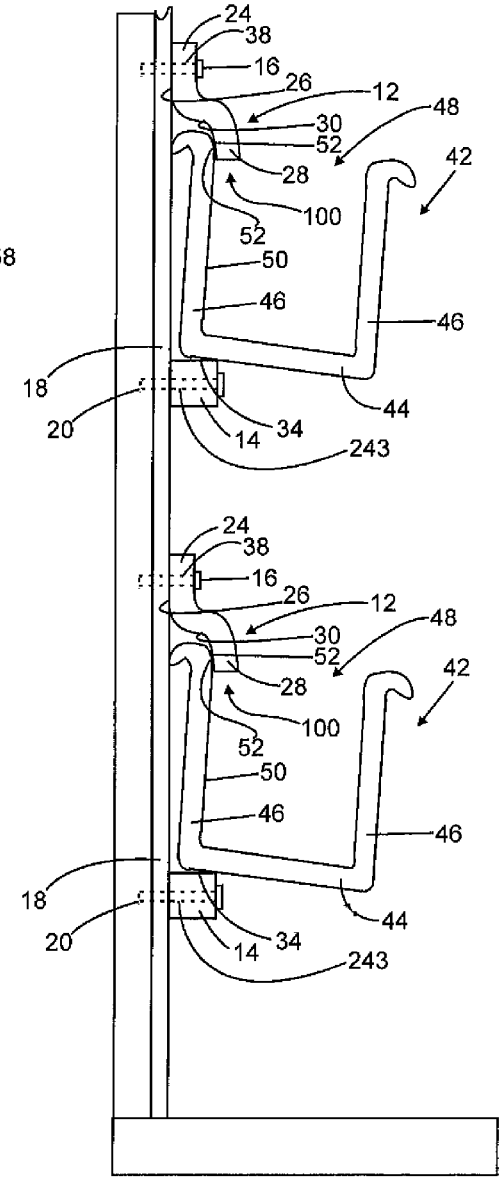
FIG. 10 illustrates a method of mounting two bins according to one embodiment of the invention utilizing two mounting kits.

Referring now to FIG. 10 one embodiment of the invention includes mounting a plurality of articles 42 on a wall 18 utilizing two or more mounting kits 10. The mounting kits 10 and the bins 42 can be mounted on the wall in vertical alignment so that enough space is provided between each bin so that article such as cans, bottles or trash can be placed in the opening 48 of the lower bin.

Figure 11:
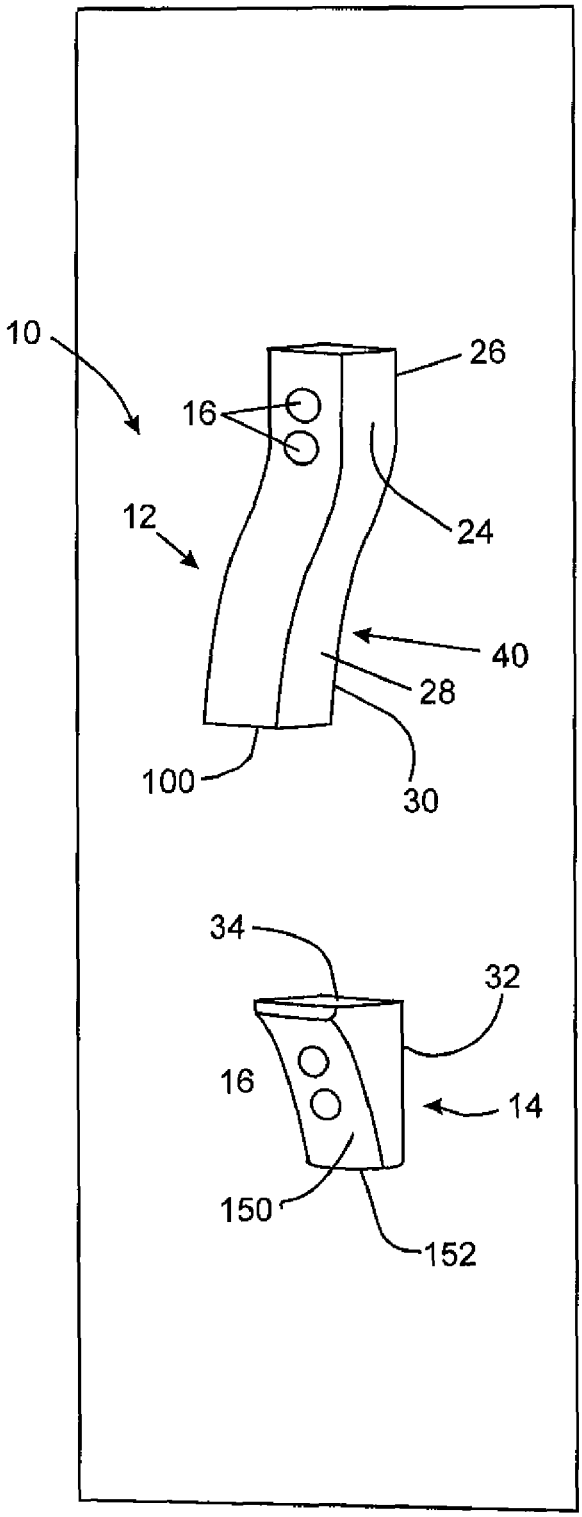
FIG. 11 illustrates another embodiment of the invention.

FIG. 11 illustrates another embodiment of the invention including a mounting kit 10 including a support hook 12 and a support block 14. The support hook 12 has a lazy S shape as described above. The support block 14 includes a first face 32 positioned to face the wall 18 and a support face 34 which faces generally upward toward the support hook 12. The support block 14 further includes a front face 150 generally extending between the support face 34 and a bottom portion of the block 14. The front face 150 may have an arcuate shape. In another embodiment of the invention, the support block 14 may have the same configuration as the support hook 12. That this, the support hook 12 may also be used as the support block 14.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A method comprising:

fastening a support hook to a wall, the support hook including a first leg portion having a first face and wherein the first face of the first leg portion faces and engages the wall, the support hook including a second leg portion having a first face constructed and arranged to face the wall at a spaced apart position to provide a gap between the first face of the second leg portion and the wall;

separately mounting a support block on the wall at a position spaced from and below the support hook, the support block including a first face positioned to face and engage the wall, and a top face facing generally upward toward the support hook;

providing an article having a bottom and a member including a lip, and moving the article so that at least a portion of the member is moved into the gap between the first face of the second leg portion of the first support hook and the wall, and so that the lip faces the first face of the second leg portion of the first support hook, and thereafter, moving the bottom of the article over the top face of the support block and allowing the bottom of the article to engage the top face of the support block, and allowing the lip to engage the first face of the second leg portion of the support hook.

2. A method as set forth in claim 1 wherein the article comprises a bin.

3. A method as set forth in claim 1 wherein the member comprises a strap.

4. A method as set forth in claim 1 wherein the member comprises a handle.

* * * * *